United States Patent [19]

Aseltine et al.

[11] Patent Number: 4,984,520

[45] Date of Patent: Jan. 15, 1991

[54] ENCLOSED PERFORATING GUN WITH EXPENDABLE CARRIER

[75] Inventors: Cliff L. Aseltine, Houston; Gary M. Lendermon, Missouri City, both of Tex.

[73] Assignee: Schlumberger Technology Corporation, Houston, Tex.

[21] Appl. No.: 344,489

[22] Filed: Apr. 26, 1989

Related U.S. Application Data

[63] Continuation of Ser. No. 229,520, Aug. 5, 1988, abandoned.

[51] Int. Cl.[5] ..... F42B 3/00

[52] U.S. Cl. ..... 102/313; 102/312; 299/13; 166/217

[58] Field of Search ..... 102/312, 313; 299/13; 175/4.52; 166/217

[56] References Cited

U.S. PATENT DOCUMENTS

| | | | |
|---|---|---|---|
| 3,307,445 | 3/1967 | Stadler et al. | 86/20 |
| 3,581,817 | 6/1971 | Kammerer, Jr. | 166/208 |
| 4,064,935 | 12/1977 | Mohaupt | 102/20 |
| 4,278,127 | 7/1981 | Rankin | 102/313 X |
| 4,433,726 | 2/1984 | Preston, Jr. et al. | 166/118 |
| 4,540,051 | 9/1985 | Schmuck et al. | 166/278 |
| 4,665,992 | 5/1987 | Franc | 166/387 |
| 4,667,735 | 5/1987 | Salerni et al. | 175/4.52 X |
| 4,762,067 | 8/1988 | Barker et al. | 102/313 |
| 4,798,244 | 1/1989 | Trost | 102/313 X |

*Primary Examiner*—Peter A. Nelson

*Attorney, Agent, or Firm*—Henry N. Garrana; John H. Bouchard

[57] ABSTRACT

In the preferred embodiment of the new and improved perforating apparatus that is described herein, a set of end closure members are cooperatively arranged to be inserted into the open ends of a length of typical piping and expanded radially outwardly into contact with the rough and irregular internal wall surface in each end of the pipe. Anchor members and sealing members are arranged on each and closure member for releasably securing and sealingly engaging these end closure members in the ends of the pipe when the end closure members are respectively expanded outwardly so that no machining operations are required to prepare the internal wall surfaces of the pipe before it can be employed as an expendable perforating carrier.

27 Claims, 3 Drawing Sheets

FIG. 2
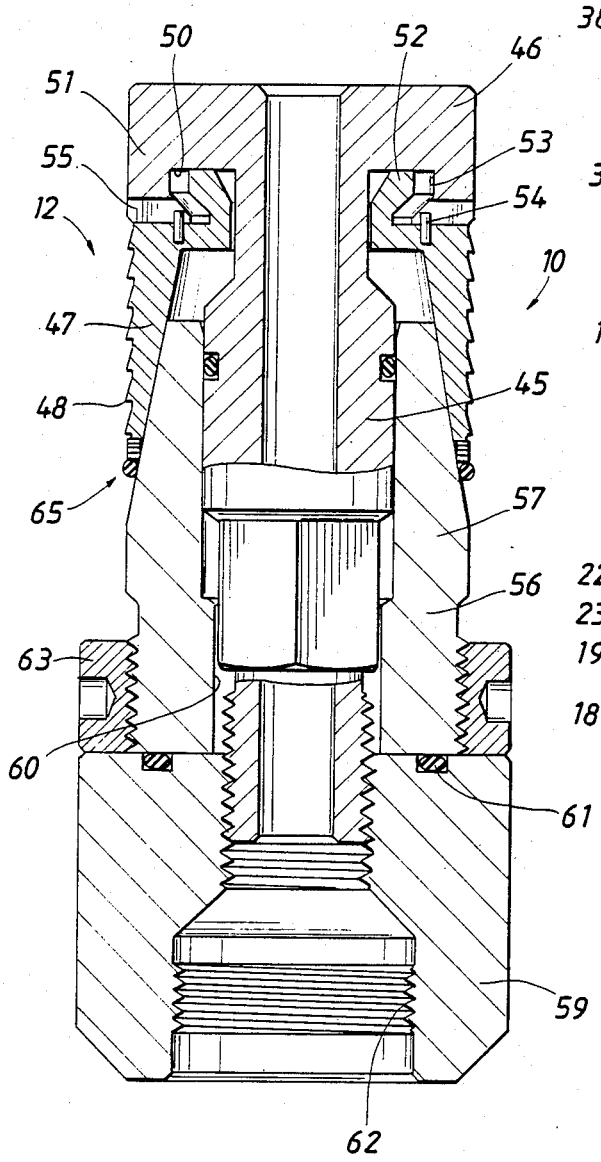
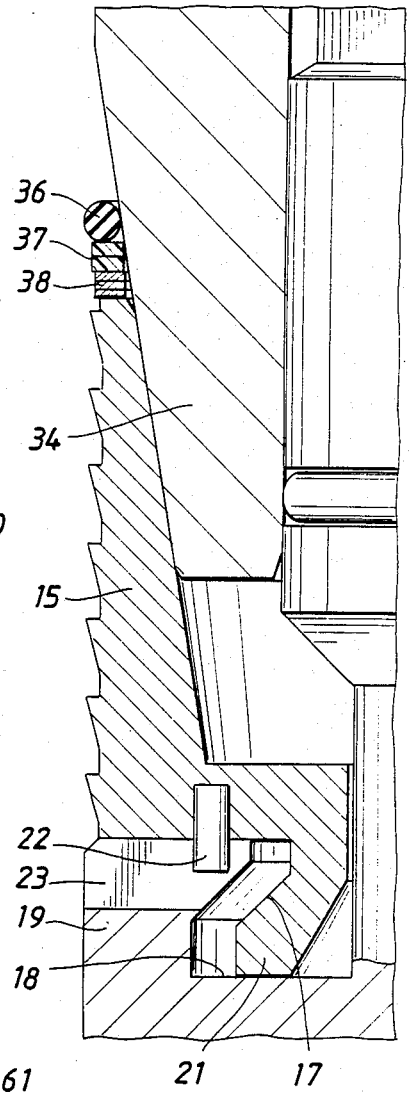
FIG. 3

ENCLOSED PERFORATING GUN WITH EXPENDABLE CARRIER

This is a continuation of application Ser. No. 07/229,520, filed Aug. 5, 1988, and now abandoned.

BACKGROUND OF THE INVENTION

This invention relates to perforating apparatus. More particularly, the present invention relates to new and improved shaped charge perforating apparatus which includes an enclosed retrievable carrier fashioned from expendable tubular products such as joints of heavy-wall piping which require no machining other than to cut the joint of pipe as needed to accommodate a given number of shaped charges.

BACKGROUND ART

Those skilled in the art will, of course, appreciate that there are several types of oil field perforators that employ a so-called "enclosed carrier" or an elongated tubular body for protecting the shaped explosive charges that are mounted therein. One type of these enclosed carriers uses a small-diameter, thin-walled expendable tubular body as described, for example, in U.S. Pat. Nos. 3,048,102 and 3,429,384 that are each assigned to the assignee of the present application and are hereby incorporated by reference. Another type of enclosed carrier employs a larger-diameter, thick-walled tubular body that is typically designed to be used for at least twenty or thirty perforating operations. To facilitate the multiple usage of these thick-walled carriers, the several shaped charges in the carrier are respectively mounted so as to face a lateral port in the carrier wall which is initially blocked by an expendable plug. U.S. Pat. Nos. 3,773,119 and 3,951,218 (which are also assigned to the assignee of the present application and are hereby incorporated by reference) illustrate typical non-expendable carriers of this type. A third typical style of enclosed carrier is shown in U.S. Pat. No. 4,744,424 which employs a large-diameter expendable tubular body which is fashioned so as to position a reduced-thickness wall portion in front of each of the shaped charges to minimize the interference with the perforating jet from each charge. This patent is also assigned to the assignee of the present application and is hereby incorporated by reference.

It will, of course, be appreciated by those skilled in the art that regardless of the particular style of the enclosed carrier, the end portions of these prior-art carriers must meet fairly rigid and precise dimensional tolerances. For example, even when a perforator is designed to be operated at relatively moderate well bore pressures, the internal diameter of the end portions of the carrier typically must not exceed the specified design diameter by more than about 0.002 to 0.003-inches. In a like manner, a similarly restrictive tolerance is also typically placed on the acceptable out-of-roundness for the internal bores of these end portions. Moreover, with these prior-art carriers, it is always essential to ensure that the internal bores of the end portions have extremely smooth surfaces on any wall portion that is to be in contact with the sealing members on their end closure members.

Accordingly, heretofore, it was considered necessary to carefully machine at least the end portions of the internal bores in these carriers to insure that their end closure members can be installed and fluidly sealed therein for reliably blocking the entrance of well bore fluids into the carrier before the gun is fired. It will be recognized that with these prior-art carriers, such as shown in U.S. Pat. No. 3,057,297, a considerable amount of precision machining was required to secure the end closure members in the ends of these carriers. As seen in U.S. Pat. No. 3,128,702, the minimum amount of this machining has consisted of one or more holes that are drilled laterally through the walls of the carrier and closure members and threaded to accommodate a corresponding number of set screws. As shown in FIGS. 4A–4C of U.S. Pat. No. 2980,017, in other prior-art carriers the ends of the tubular bodies have been crimped into circumferential grooves in the end closure members for augmenting the holding force of the set screws. In any case, it will be appreciated that these additional machining operations clearly represent a significant part of the overall manufacturing costs of these various prior-art carriers.

OBJECTS OF THE INVENTION

Accordingly, it is an object of the present invention to provide new and improved expendable perforator carriers that are assembled from standard piping with no preliminary machining operations being required other than to cut it to a given length.

It is another object of the invention to provide new and improved end closure members which can be placed in the open ends of standard piping and expanded into sealing and gripping engagement with the irregular and rough internal surfaces found in the end portions of such piping without having to prepare the end portions to provide smooth and regular internal surfaces.

It is still another object of the present invention to provide new and improved perforating apparatus having an enclosed carrier that is a length of standard piping having upper and lower end portions with unmachined rough and irregular internal surfaces and upper and lower end closure members cooperatively arranged to be fitted into these unmachined end portions and sealingly and anchoringly engaged within these end portions to provide smooth and regular internal surfaces.

It is yet another object of the present invention to provide new and improved perforating apparatus having an enclosed carrier that is a length of standard piping having unmachined end portions and end closure members arranged to be fitted into these unmachined ends and sealingly and anchoringly engaged with the unmachined rough and irregular internal surfaces therein.

SUMMARY OF THE INVENTION

These and other objects of the present invention are attained by providing new and improved end closure members which are cooperatively arranged to be inserted into the open ends of a length of typical piping and expanded radially outwardly into contact with the rough and irregular internal wall surfaces in each end of the pipe. Anchoring means and sealing means are arranged on each end closure member for releasably securing and sealingly engaging these end closure members in the end portions of the pipe when the end closure members are expanded outwardly so that no machining operations are required to prepare the end portions of the pipe for service as an expendable perforating carrier.

BRIEF DESCRIPTION OF THE DRAWINGS

The several patentable features and distinctive aspects of the present invention are set forth with particularly in the appended claims. The arrangement and operation of the invention, together with further objects and various advantages thereof, may best be understood by way of the following written description of a preferred embodiment of apparatus incorporating the principles of the invention when taken in conjunction with the accompanying drawings, in which:

FIGS. 1 and 2 are cross-sectioned elevational views respectively illustrating a preferred embodiment of upper and lower end closure members which are arranged in accordance with the principles of the invention;

FIG. 3 is an enlarged elevational cross-sectional view of a major portion of the upper end closure member shown in FIG. 1 for showing in detail the anchoring and sealing elements of the new and improved end closure members;

DESCRIPTION OF A PREFERRED EMBODIMENT

Figure 1:
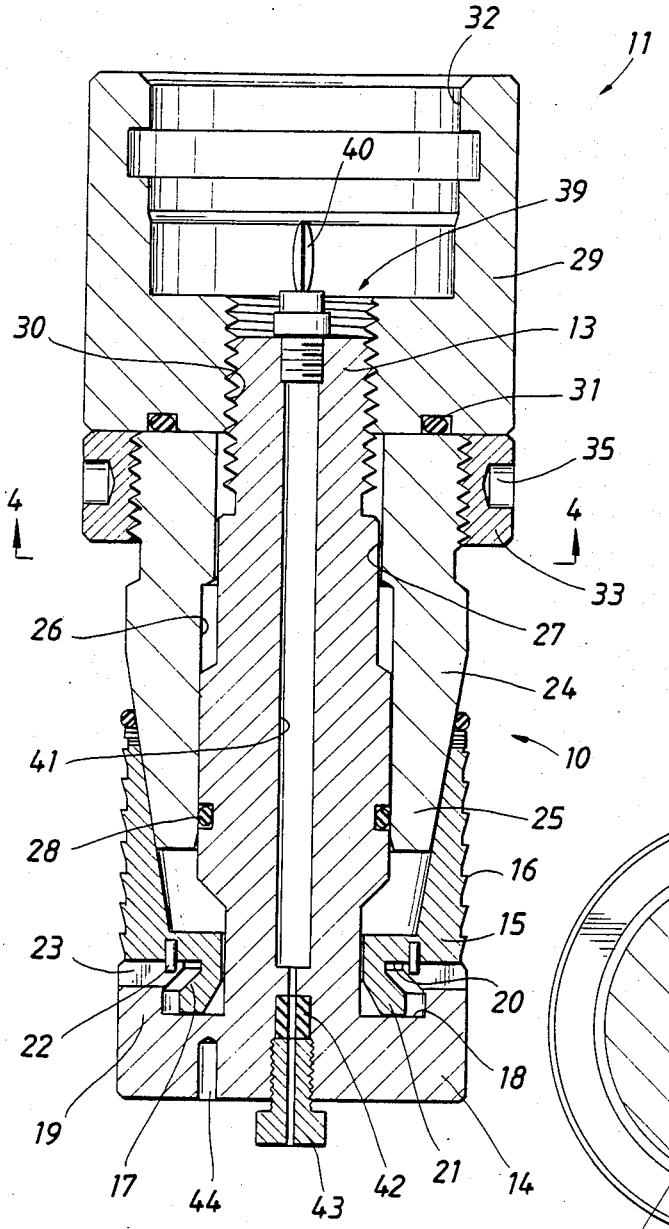

Turning now to FIGS. 1 and 2, the new and improved perforating apparatus 10 of the present invention is depicted as including end closure members 11 and 12 arranged in keeping with the principles of the invention and respectively representing the upper and lower end closure members of the apparatus. As shown in FIG. 1, the upper end closure member 11 includes a central mandrel 13 which has an enlarged-diameter lower end portion 14. The end closure member 11 further includes anchoring means such as a plurality of sectorially shaped anchor elements, as at 15, which, as depicted in FIGS. 1 and 3, are arranged in upright positions and disposed at closely spaced intervals around the lower portion of the mandrel 13. Each of the anchor elements 15 is provided with a set of hardened outwardly-directed teeth, as at 16, spatially spaced along the outer edges of the elements. In the preferred embodiment of the perforating apparatus 10 it was found advantageous to utilize six identical anchor elements 15 which are uniformly distributed around the mandrel 13 and sized to leave only minimal clearance spaces or gaps between the opposed sides of adjacent anchor elements once the end closure member 11 is finally installed in the perforating apparatus 10.

As shown in FIGS. 1 and 3, the lower end of each of the anchor elements 15 is provided with a depending outwardly-directed projection or base portion, as at 17, which is slidably engaged on a flat upper surface 18 inside of an upstanding rim 19 around the enlarged mandrel portion 14. To loosely couple these anchor elements 15 to the mandrel 13, the inwardly facing surface of this upstanding rim 19 is undercut for defining an inwardly directed recess, as at 20, completely around the inside surface of the rim; and the outer surfaces of the base portions 17 of the anchor elements 15 are each undercut so as to define complemental outwardly-directed projections 21 on the base portions which are loosely confined within the recess. It should be noted from the drawings that the recess 20 in the rim 19 as well as the outward projections 21 are appropriately shaped and sized for defining a substantial clearance space between their respective downwardly and upwardly facing opposing transverse surfaces that will give the anchor elements 15 sufficient freedom to be moved radially inwardly and outwardly relative to the mandrel 13 over a limited span of travel. It is, however, preferred to prevent or limit rotational movement of the anchor elements 15 in relation to the mandrel 13 by respectively arranging depending pins, as at 22, in the base portions 17 of these elements that are loosely disposed within upwardly facing radial grooves, as at 23, that are spaced at equal intervals around the perimeter of the rim 19. It will, therefore, be appreciated that although the anchor elements 15 are loosely coupled to the enlarged mandrel portion 14, they are basically limited to moving radially inwardly and outwardly in relation to the mandrel 13.

Figure 4:
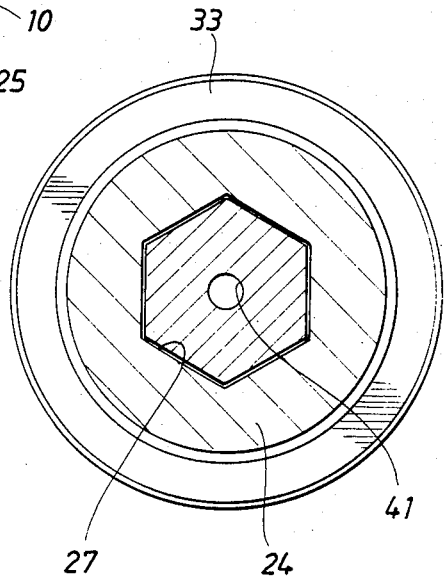
FIG. 4 is a transverse cross-sectional view taken along the lines "4—4" of FIG. 1.

As depicted in FIG. 1, the upper end closure member 11 of the present invention also includes a thick-walled tubular body 24 which is slidably mounted around the mid-portion of the mandrel 13. The thick-walled tubular body 24 is cooperatively shaped for providing a frustoconical lower end portion 25 which is adapted to be disposed within a complemental upwardly-directed frustoconical recess that is collectively defined by the upwardly and outwardly-tapered edge surfaces of the anchor elements 15 once the end closure member 11 is assembled. For reasons which will subsequently become apparent, it is necessary to prevent the thick-walled body 24 from turning in relation to the mandrel 13 without unduly limiting relative longitudinal movement between those two members. Accordingly, as depicted in FIG. 4, in the preferred embodiment of the new and improved end closure member 11 an external portion of the central mandrel 13 and the adjacent portion of the axial bore 26 in the thick-walled body 24 are each shaped with complemental hexagonal cross-sections for providing opposed mating surfaces, as at 27, with sufficient surface areas to keep the body from turning in relation to the mandrel. In order to fluidly seal the mandrel 13 and the thick-walled member 24 relative to one another, a circumferential groove is arranged around a cylindrical portion of the central mandrel for receiving a sealing member, such as an O-ring 28, that is sealingly engaged with the adjacent internal surface of the thick-walled tubular member as the perforating apparatus 10 is being assembled.

Referring again to FIG. 1, it will be seen that a second thick-walled tubular member 29 is rotatably mounted on top of the first thick-walled member 24 and, as indicated generally at 30, threadedly coupled to the upper end portion of the central mandrel 13. In order to fluidly seal the thick-walled members 24 and 29 relative to one another, an annular groove is arranged in the lower face of the upper thick-walled member for receiving a sealing member, such as an O-ring 31, which can be pressed into sealing engagement with the upper face of the lower thick-walled tubular member as the perforating apparatus 10 is assembled. The upper end of the thick-walled tubular member 29 is counterbored and appropriately configured and sized as necessary to provide a socket 32 in the new and improved upper end-closure member for coupling the end closure member 11 of the present invention to other apparatus or tools such as a typical collar locator and a cable head that is appropriately arranged to be dependently coupled to the lower end of a suspension cable having electrical conductors (not shown in the drawings) as fully described in the previously-referenced U.S. Pat. No. 3,773,119. Alternatively, the socket 32 can also be arranged so that the new and improved perforating apparatus 10 of the present invention can also be connected to the lower end of a tubing string (not shown in the drawings) such as the perforator disclosed in U.S. Pat. No. 4,509,604. This latter patent is assigned to the assignee of the present application and is hereby incorporated by reference. As fully explained in these above-referenced patents, in either case it is apparent to one with only ordinary skill in the art which additional tools and apparatus will be needed for arranging the perforating apparatus 10 for successful commercial operation. It is apparent, therefore, that the particular configuration of the socket 32 is outside of the scope of the present invention.

A ring member 33 is rotatably mounted on the upper end of the thick-walled member 24 and, as shown generally at 34, the two members are complementally threaded. As is typical for many oilfield tools, blind holes, as at 35, are drilled partway into diametrically-opposed external surfaces of the threaded ring 33 for accommodating opposed projections of wrenches (not shown in the drawings) that are commonly used for tightening and loosening threaded components such as the member.

As previously discussed, those skilled in the art have heretofore considered it necessary to carefully machine at least the end portions of enclosed perforator carriers to be certain that the prior-art end closure members can prevent the entrance of well bore fluids into the carriers. Accordingly, in keeping with the objects of the present invention, the upper end closure member 11 is further provided with fluid-sealing means which, as shown in detail in FIG. 3, in the preferred embodiment of the end closure member 11 include a typical O-ring 36 and upper and lower backup rings 37 and 38 which are arranged around the mid-portion of the frustoconical end portion 25 of the thick-walled tubular body 24 and stacked on top of the upper ends of the anchor elements. In the preferred embodiment of the upper end closure member 11, the O-ring 36 is fabricated from a relatively-resilient elastomeric material such as rubber or a neoprene nitrile having a hardness in a range between about 70-durometers and about 90-durometers. Likewise, in the preferred embodiment of the end closure member illustrated in FIG. 1, the upper ring 37 is fabricated of a relatively yieldable or deformable plastic material such as a glass-filled nylon that is preferably arranged as a flat strip having a rectangular cross-section that is wound in a multi-layer helix with its major dimension or axis being perpendicular to the central axis of the upper end closure member 11. Preferably the upper backup ring 37 will be arranged with two or slightly more than two turns. The lower backup ring 38 is a flat steel strip having a rectangular cross-section that is similarly wound in a multi-layer helix with its major dimension being perpendicular to the central axis of the end closure member 11. The backup ring 38 is preferably arranged with slightly more than two turns.

The upper end closure member 11 also includes a typical electrical feed-through connector, as generally shown at 39, in FIG. 1 that is appropriately arranged for connecting electrical devices in the new and improved perforating apparatus 10 below the upper end closure member with electrical devices above the end closure member. Since a perforating gun typically requires only a single isolated conductor, in the preferred embodiment of the upper end closure member 11 the feed-through connector 39 has an upstanding bayonet connector 40 that is threadedly installed in the upper end of an axial bore 41 through the mandrel 13 and electrically insulated in an appropriate manner from the mandrel. The lower end of the axial bore 41 is counterbored and threaded for receiving a tubular spacer 42 and a threaded tubular plug 43. A threaded hole 44 is provided in the lower end of the enlarged lower end portion 14 of the mandrel 13 so that a second wire (not seen in FIG. 1) can be electrically connected to the body of the perforating apparatus 10 to provide a suitable return path.

Turning now to FIG. 2, the lower end closure member 12 of the present invention is depicted. It will, of course, be recognized by comparing FIGS. 1 and 2 that the two end closure members 11 and 12 are very similar to one another and preferably arranged with a substantial number of interchangeable elements so as to simplify the manufacture and stocking of the end closure members. Accordingly, to simplify the description of the lower end closure member, those elements of the lower member 12 which are similar or identical to a corresponding element of the upper member 11 will not be described in detail. As shown in FIG. 2, the lower end closure member 12 includes a central mandrel 45 which has an enlarged-diameter upper end portion 46. The end closure member 12 also includes a plurality of sectorially shaped anchor elements 47 disposed at closely spaced intervals below the lower portion of the mandrel 45. Hardened outwardly-directed teeth 48 are also arranged along the outer edges of the lower anchor elements 47.

The upper ends of the anchor elements 47 are similarly arranged with inwardly-directed projections, as at 49, which are slidably engaged on a flat downwardly-facing surface 50 inside of a dependent peripheral rim 51 around the enlarged upper portion 46 of the mandrel 45. As was the case with the upper end closure member 11, each of the anchor elements 47 is loosely coupled to the mandrel 45 by outwardly-directed projections 52 respectively disposed in a complemental inwardly directed recess 53 around the rim 51. Hereagain, by loosely confining the projections 52 in the recess 53, the lower anchor elements 47 will be free to move radially in relation to the mandrel 45 within a restricted span of travel. The lower anchor elements 47 are each provided with an upstanding guide pin, as at 54, in their upper end portions 49 that are loosely disposed within radial grooves, as at 55, that are spaced at equal intervals around the rim 51.

As depicted in FIG. 2, the lower end closure member 12 includes a thick-walled tubular body 56 having a frustoconical lower end portion 57 which is slidably mounted around the midportion of the mandrel 45 and disposed within a complemental downwardly-directed frustoconical recess that is collectively defined by downwardly and outwardly-tapered edge surfaces on the anchor elements 47 once the end closure member 12 is assembled. To prevent the thick-walled body 56 from turning in relation to the mandrel 45, adjacent portions of the mandrel and the thick-walled body are respectively shaped for defining complemental hexagonal cross-sections with opposed surfaces as at 58.

As depicted, a thick-walled tubular body 59 is mounted below the thick-walled member 56 and, as shown at 60, threadedly coupled to the lower end portion of the central mandrel 45. An annular groove in the upper face of the thick-walled member 59 carries an O-ring 61 to be pressed into sealing engagement with the lower face of the thick-walled tubular body 59 whenever the perforating apparatus 10 is assembled. The lower portion of the thick-walled tubular member 59 is counterbored and threaded to provide a socket 62 in the new and improved lower end-closure member 12 that can either be closed by an appropriate threaded plug when no other tools are to be dependently coupled to the perforating apparatus 10 or left open to provide access to other tools dependently coupled to the lower end closure member. A ring member 63 is rotatably mounted and threadedly coupled on the lower end of the thick-walled body 45. As will be subsequently described in more detail, the lower end closure member 12 is provided with sealing means 65 identical to the sealing means of the upper end closure member 11.

Figure 5A:
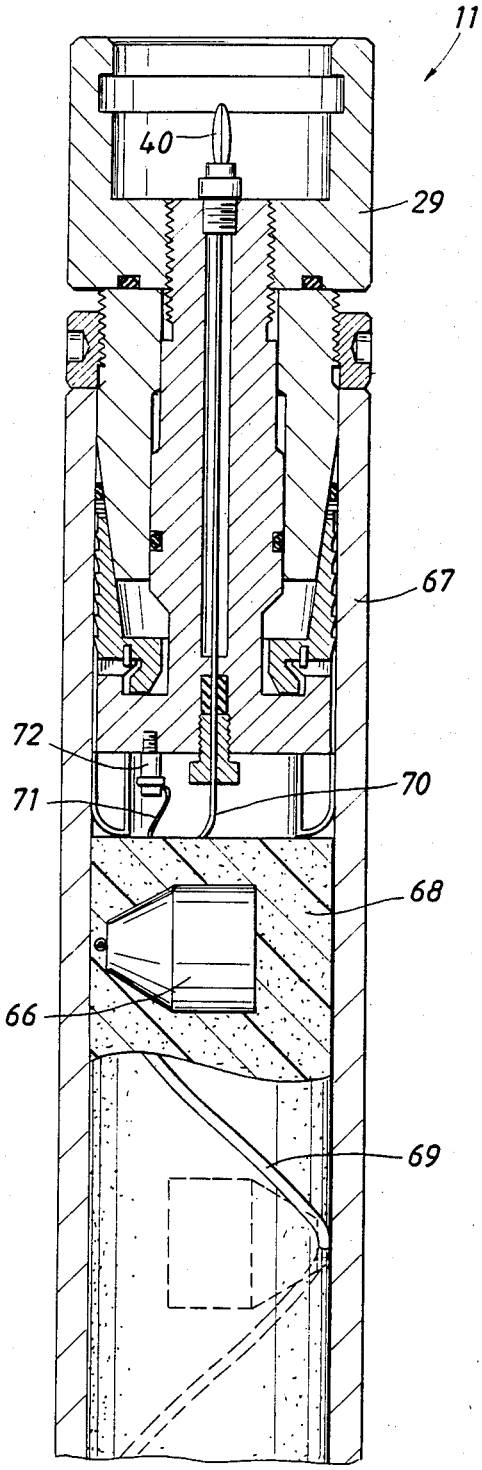
FIGS. 5A and 5B are elevational views of the upper and lower end portions of a preferred embodiment of a new and improved perforator which are partially cross-sectioned to better illustrate various details of the end closure members shown in FIGS. 1 and 2 after they have been installed in the open ends of a length of pipe providing the body of the perforator.
Figure 5B:
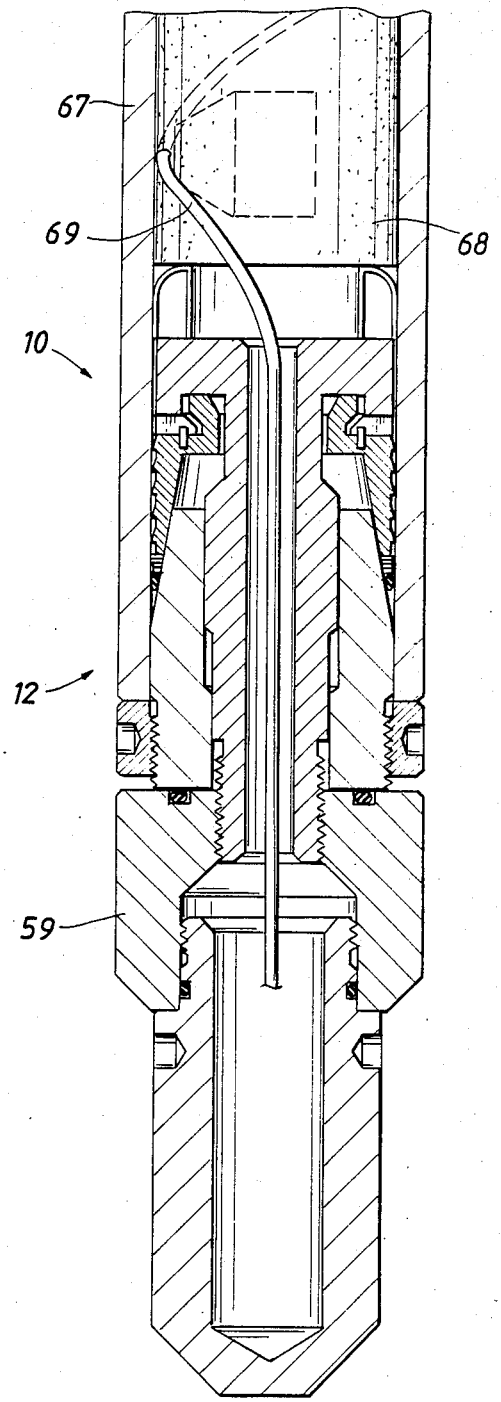

Turning now to FIGS. 5A and 5B, the new and improved perforating apparatus 10 of the present invention is shown as it will appear when it has been assembled. To initiate the assembly of the perforating apparatus 10, a joint of standard pipe is cut to the particular length needed to carry a given number of shaped explosive charges, as shown at 66, which are spatially disposed at desired intervals within the length of pipe 67. Those skilled in the art will, of course, appreciate that the particular manner in which the several shaped charges, as at 66, are arranged and the number of these charges are totally outside of the scope of the present invention. It will, therefore, be understood that the principles of the invention are considered to be applicable to any arrangement of shaped explosive charges that can be fitted into the pipe carrier 67. Accordingly, if desired, in keeping with the teachings of either of the previously-incorporated U.S. Pat. Nos. 3,048,102 and 3,429,384, the shaped charges 66 could be adequately supported within the pipe carrier 67 by means of an elongated metal strip having longitudinally-spaced apertures that respectively hold a charge so as to direct it to one side or the other of the carrier. Alternatively, the several shaped charges 66 could also be cooperatively supported as depicted in either of the other patents previously incorporated by reference.

In the preferred embodiment of the new and improved perforating apparatus 10, an elongated cylinder 68 of a typical moldable plastic is arranged with a series of cavities which are complementally shaped as required to receive the shaped charges 66 and position them for firing along selected perforating axes in one or more given lateral directions. A length of detonating cord 69 is wrapped around the charge support 68 and positioned as necessary thereon to place the detonating cord within detonating proximity of each shaped charge 66. As is typical, an electrical blasting cap (not seen in the drawings) is operatively coupled to one end of the detonating cord 69. The longitudinal distance or spacing between the several charges 66 will, of course, depend upon the particular needs of a given perforating operation; but a spacing in the order of four charges per foot of carrier length has been found to be satisfactory. It will, of course, be recognized that the plastic charge support 68 and the shaped charges 66 will be installed in the pipe carrier 67 before both of the upper and lower end closure members 11 and 12 have been installed.

To install the upper end closure member 11 in the upper end of the pipe carrier 67, a first electrical conductor 70 that is adapted to be connected to the electrical blasting cap (not shown in the drawings) is passed through the tubular spacer 42 and the plug 43 and extended through the mandrel bore 41 and then connected to the insulated portion of the bayonet connector 40. A second conductor 71 is connected by means of a screw 72 that is fitted into the threaded hole 44 in the lower end of the enlarged lower end portion 14 of the mandrel 13. The upper end closure member 11 is then inserted into the upper end of the pipe carrier until the lower face of the threaded ring 33 is a short distance above the upper end of the pipe. It should be noted that at this point, the threaded ring 33 is positioned on the uppermost ones of the threads 34 on the thick-walled tubular body 24 and the thick-walled end member 29 is also positioned on the uppermost threads 30 on the mandrel 13.

Once the end closure member 11 has been moved to this position, the mandrel 13 is then shifted upwardly in relation to the pipe carrier 67 and the thick-walled tubular body 24. This can, of course, be initially carried out by manually rotating the end member 29 on its threads 30 so as to raise the mandrel 13 in relation to the body 24. As the mandrel 13 is shifted upwardly, the tapered upper ends of the anchor elements 15 are collectively advanced into the complementally-tapered cavity between the inner wall of the pipe 67 and the external surface of the frustoconical lower end portion 25 of the thick-walled body 24. Those skilled in the art will recognize, of course, that as the anchor elements 15 are advanced upwardly, the frustoconical end portion 25 of the thick-walled body 24 will progressively drive the hardened teeth 16 on the anchor elements outwardly into gripping engagement with the inner wall surface of the pipe carrier 67.

In keeping with the objects of the invention, it must be recognized that inasmuch as the respective anchor elements 15 are independently movable in relation to each other, they will be able to move laterally to whatever position as may be required to accommodate any out-of-roundness that might be present in the end of the pipe carrier 67. Moreover, it will be further recognized that the anchor elements 15 are also capable of moving laterally over a wide span that is more than sufficient to accommodate the maximum and minimum internal diameters of the particular size of piping that is chosen for the carrier 67. Accordingly, by virtue of their freedom to move independently of one another, the anchor elements 15 will always be moved outwardly into the adjacent wall of the carrier 67 to assure that all of the teeth 16 are engaged with the wall for uniformly distributing the axial loads imposed on the end closure member 11.

As the tapered upper ends of the anchor elements 15 are collectively advanced upwardly into the cavity between the inner wall of the pipe 67 and the frustoconical lower end portion 25 of the thick-walled body 24, it will be appreciated that the teeth 16 on the anchor elements will be set into the adjacent surfaces of the pipe. Then, as the upper member 29 is advanced further downwardly along the threads 30, the O-ring 36 and the backup rings 37 and 38 will be trapped in the progressively-narrowing cavity defined between the frustoconical lower end portion 25 on the downwardly-moving anchor expanding member 24. At the same time, the O-ring 31 on the lower face of the upper member 29 will be firmly pressed into sealing engagement against the opposing upper surface of the anchor expanding member 24. The opposed hexagonal surfaces 27 on the mandrel 13 and the member 24 will, of course, keep the anchor expanding member from being rotated in relation to the mandrel as the upper body 29 is advanced along the mandrel threads 30.

It will, therefore, be appreciated that once the teeth 16 on the anchor elements 15 have been firmly engaged against the internal wall of the pipe 67, there will be a small gap between the side walls of each of the several anchor elements. Thus, in keeping with the objects of the present invention, it will be seen that the steel backup ring 38 will be resting on the upper ends of the anchor elements 15. Since the backup ring 38 is formed so as to preferably have somewhat more than two complete turns, there will always be a double thickness of the steel ring spanning the circumferential gaps respectively defined between the upper ends of the anchor elements 15 which will be effective to prevent the well bore pressure from extruding the O-ring 36 or the plastic backup ring 37 into these gaps. To be certain that the steel backup ring 38 is free to circumferentially expand as necessary, the transverse width (i.e., the major cross-sectional dimension) of the backup ring is selected to be slightly smaller than the smallest expected radial space or gap between the outer surface of the frustoconical portion 25 and the inner wall surface of the pipe 67.

Since the internal surfaces of the pipe 67 will often be fairly rough and irregular, it will be recognized that there will always be small spaces between the internal wall surface of the pipe and the exterior edge of the steel ring 38. It is, of course, possible that only three or four points around the outer perimeter or exterior edge of the steel ring 38 may actually come in contact with the internal wall surface of the pipe 67. Thus, in the preferred embodiment of the new and improved perforating apparatus 10, the plastic backup ring 37 is arranged so that its outer diameter is slightly greater than the outer diameter of the steel backup ring 38. In this manner, as the upper end closure member 11 is being installed into the pipe 67, the plastic backup ring will be deformed into the adjacent irregularities caused by roughness in the wall of the pipe 67 as well as extruded into the small spaces between the internal wall surface of the pipe and the exterior edge of the steel ring 38.

By virtue of the resilience of the O-ring 36, it will be appreciated that the O-ring will be compressed as needed to provide a fluid seal for accommodating any out-of-roundness and surface roughness that might be present in the end of the pipe carrier 67. Since the coaction of the backup rings 37 and 38 accommodates the irregularities or any dimensional variations in the wall of the pipe 67 as well as spans the narrow gaps between the adjacent anchor elements 15, it will be appreciated that the O-ring 36 will be fully supported against being extruded between the anchor elements 15 whenever the perforating apparatus 10 is subjected to well bore pressures.

It will be recognized that since the interior of the carrier 67 is typically left at atmospheric pressure, whenever the perforating apparatus 10 is subjected to well bore pressures, these pressures will also tend to force the end closure member 11 further inwardly into the pipe carrier 67. Any movement of the end closure member 11 further into the pipe carrier 67 would of, course, disrupt the anchoring engagement of the anchor elements 15 and the sealing engagement of the O-ring 36. Accordingly, to prevent this, once the end closure member 11 is positioned and the anchor elements 15 and the sealing member 36 are respectively engaged with the carrier wall, the threaded ring 33 is rotated downwardly until it contacts the upper end of the pipe. Once the ring 33 is firmly seated against the upper end of the carrier 67, it will support the thick-walled member 24 against the pressure forces that would otherwise tend to drive the end closure member 11 on further into the carrier 67.

When a perforating operation has been completed and it is desired to remove the end closure member 11 from the carrier 67, it is necessary only to loosen the upper member 29 and the threaded ring 33 and then strike the upper end of the member 29 with a hammer. By virtue of the gap between the opposed surfaces of the inwardly-directed base portions 17 of the anchor elements 15 and the rim 19 around the enlarged mandrel portion 14, the mandrel 13 is initially driven downwardly in relation to the anchor elements and then, once the space is closed up, acts to pull the anchor elements out of engagement with the frustoconical nose portion 25 of the anchor expanding body 24. Once this takes place, the end closure member 11 is freed from the carrier 67 and can be readily removed from the pipe. It will, of course, be understood that the installation and removal of the lower end closure member 12 are carried out in essentially the same manner as the above-described corresponding actions for installing and removing the upper end closure member 11.

Those skilled in the art will appreciate that the type of pipe utilized for the carrier 67 is important for carrying out the objects of the present invention. Accordingly, a preferred manner of carrying out the purposes of the invention, it has been found that a standard 3.5 inch Schedule 80 seamless or ERW pipe can be used for the carrier 67. This particular grade of piping meets the API5L Grade B specifications. If the pipe is a welded pipe, in order to give improved ductility to the weld seam of the pipe it is preferred that it be appropriately heat treated until no untempered Martensite or high residual stresses remain. To ensure that the pipe has been properly stress relieved, it is preferred that the stress relieving treatments are carried out after cold straightening of the pipe.

Accordingly, it will be appreciated that the present invention has provided new and improved apparatus for conducting inexpensive perforating operations in well bores. By arranging the new and improved end closure members of the present invention with sealing and anchoring elements that are uniquely arranged to be expanded into reliable sealing and gripping engagement with irregular and rough internal surfaces, inexpensive lengths of standard piping having unmachined end portions can be employed as enclosed perforator carriers without having to precisely machine these end portions for providing smooth and regular internal surfaces.

While a particular embodiment of the present invention has been shown and described, it is apparent that changes and modifications may be made without departing from this invention in its broader aspects; and, therefore, the aim in the appended claims is to cover all such changes and modifications as may fall within the true spirit and scope of this invention.

What is claimed is:

1. Perforating apparatus comprising:

a pipe having rough and irregular internal wall surfaces; and a set of end closure members in each end of said pipe and expanded radially outwardly against said internal wall surfaces, each of said closure members including a mandrel with an enlarged portion and a threaded portion, a set of anchor elements movably arranged around said mandrel and having bases slidably disposed on said enlarged mandrel portion and upstanding end portions with serrated outer edges and inner edges defining a frustoconical recess around said mandrel, a first body slidably arranged on said mandrel having a frustoconical nose complementally fitted in said recess, a second body threadedly coupled to said threaded mandrel portion for advancing said nose toward said enlarged mandrel portion and into said recess for shifting said anchor elements outwardly to anchor said serrated edges with said internal wall surfaces, and means providing a fluid-tight seal between said nose and said internal wall surfaces including a rigid backup ring arranged around said nose and engaged with said upstanding end portions for bridging gaps left therebetween, a deformable backup ring arranged around said nose and said rigid ring for filling circumferential spaces between said rigid ring and said internal wall surfaces, and an annular sealing member arranged around said nose and said deformable ring for being sealingly engaged between said nose and said internal wall surfaces when said anchor elements are engaged therewith.

2. The perforating apparatus of claim 1 wherein said pipe meets at least API5L Grade B specifications.

3. The perforating apparatus of claim 2 wherein said pipe is ERW piping which has been heat treated for substantially removing residual stresses and untempered Martensite along its weld seam.

4. The perforating apparatus of claim 2 wherein said pipe is seamless.

5. The perforating apparatus of claim 1 wherein said pipe is a Schedule 80 pipe meeting at least API5L Grade B specifications.

6. The perforating apparatus of claim 5 wherein said pipe is ERW piping which has been heat treated for substantially removing residual stresses and untempered Martensite along its weld seam.

7. The perforating apparatus of claim 5 wherein said pipe is seamless.

8. The perforating apparatus of claim 1 wherein said rigid rings are each formed from a flat metal strip having a rectangular cross-section and wound in a multi-layer helix of at least two turns with its major cross-sectional dimension perpendicular to said mandrel.

9. The perforating apparatus of claim 1 wherein said deformable rings are each formed from a flat strip of a deformable plastic having a rectangular cross-section and wound in a multi-layer helix of at least two turns with its major cross-sectional dimension perpendicular to said mandrel.

10. The perforating apparatus of claim 1 wherein said rigid rings are each formed from a flat metal strip having a rectangular cross-section and wound in a multi-layer helix of at least two turns with its major cross-sectional dimension of said flat metal strip being perpendicular to said mandrel and said deformable ring is a flat strip of deformable plastic having a rectangular cross-section wound in a multi-layer helix of at least two turns with the major cross-sectional dimension of said flat plastic strip being perpendicular to the longitudinal axis of said mandrel.

11. The perforating apparatus of claim 1 further including means providing a fluid-tight electrical connection between the ends of said mandrel of at least one of said end closure members.

12. The perforating apparatus of claim 1 further including means including a threaded ring cooperatively arranged on each of said second bodies for being abutted against the adjacent end of said pipe for preventing movement of said end closure members further into said pipe after said anchor elements have been shifted into anchoring engagement therewith.

13. The perforating apparatus of claim 1 further including means cooperatively arranged between said enlarged mandrel portion and said bases of said anchor elements slidably retaining said anchor elements in their respective angular positions on said enlarged mandrel portion as said anchor elements are shifted outwardly.

14. Perforating apparatus comprising:

a tubular pipe having first and second end portions with rough and irregular internal wall surfaces; and first and second end closure members respectively arranged to be installed into said first and second end portions of said pipe and cooperatively expanded radially outwardly into anchoring and sealing engagement with said internal wall surfaces, each of said end closure members having a mandrel with enlarged and threaded portions, a plurality of sectorially-shaped anchor elements arranged around an intermediate portion of said mandrel having base portions slidably disposed on said enlarged mandrel portion and upstanding portions with serrated outer edges and outwardly-inclined inner edges collectively defining a frustoconical recess around said mandrel, a first body slidably disposed around said intermediate mandrel portion and having a frustoconical portion complementally fitted in said recess, a second body cooperatively arranged on said threaded mandrel portion for moving said first body toward said enlarged mandrel portion and advancing said frustoconical portion further into said recess to shift said anchor elements outwardly for anchoring their said serrated edges with said internal wall surfaces, a rigid backup ring arranged on said frustoconical portion and disposed across the ends of said upstanding portions of said anchor elements for bridging radial gaps left therebetween when they are anchoringly engaged with said internal wall surfaces, a deformable backup ring arranged on said frustoconical portion and disposed on said rigid backup ring for filling circumferential spaces left between said deformable backup ring and said internal wall surfaces, and a resilient O-ring coaxially arranged on said frustoconical portion and said deformable backup ring to be sealingly engaged between said frustoconical portion and said internal wall surfaces of said pipe when said anchor elements are engaged therewith.

15. The perforating apparatus of claim 14 wherein each of said backup rings is formed from a flat strip having a rectangular cross-section which is wound in a helix of at least two abutting turns with the major cross-sectional dimensions of said strips being perpendicular to the central axis of said mandrel, each of said rigid backup rings being formed from steel and each of said deformable backup rings being formed from a deformable plastic.

16. The perforating apparatus of claim 14 wherein said pipe is a Schedule 80 pipe meeting at least API5L Grade B specifications.

17. The perforating apparatus of claim 16 wherein said pipe is ERW piping which has been heat treated for substantially removing residual stresses and untempered Martensite along its weld seam.

18. The perforating apparatus of claim 16 wherein said pipe is seamless.

19. The perforating apparatus of claim 14 further including at least one shaped explosive charge mounted within said pipe and detonating means cooperatively arranged in detonating proximity of said shaped charge.

20. The perforating apparatus of claim 19 wherein said detonating means include an electrically-responsive detonator; and further including means providing a fluid-tight electrical connection between the ends of one of said mandrels, and means electrically connecting said fluid-tight connection means to said detonator.

21. The perforating apparatus of claim 14 wherein said first and second end closure members respectively include a threaded ring cooperatively arranged on each of said second bodies to be moved into abutment against the end of said pipe for preventing further movement of said end closure members into said pipe after said anchor elements have been anchoringly engaged therewith.

22. The perforating apparatus of claim 14 further including at least one shaped explosive charge mounted within said pipe; charge-detonating means including a detonating cord cooperatively arranged in detonating proximity of said shaped charge and an electrically-responsive detonator cooperatively arranged within detonating proximity with said detonating cord; electrical feed-through means cooperatively arranged within one of said mandrels providing a fluid-tight electrical connection between the ends of said one mandrel; and electrical conductor means interconnecting said electrical feed-through means and said detonator.

23. The perforating apparatus of claim 14 further including means cooperatively arranged between said enlarged mandrel portion and said bases of said anchor elements slidably retaining said anchor elements in their respective angular positions on said enlarged mandrel portion as said anchor elements are shifted outwardly.

24. Coupling apparatus adapted for coupling an end of a pipe having internal wall surfaces to other apparatus, comprising:

a mandrel including a center portion; an anchor element movably arranged around said mandrel and adapted to be disposed within said pipe, said anchor element including an upstanding end portion having irregularly shaped outer edges, an inner edge of said upstanding end portion defining a recess around said mandrel;

means disposed between the center portion of said mandrel and said upstanding end portion of said anchor element for expanding said upstanding end portion radially outwardly, the irregularly shaped outer edges of said upstanding end portion gripping said internal wall surfaces of said pipe when said anchor element is disposed within said pipe and said upstanding end portion of said anchor element is expanded radially outwardly, the means for expanding including, a first body slidably arranged on said mandrel and having a nose complementally fitted in said recess, and a second body threadedly coupled to said center portion for advancing said nose into said recess and shifting said anchor element outwardly to further grip said irregularly shaped outer edges of said upstanding end portion against said internal wall surfaces of said pipe when said anchor element is disposed within said pipe; and means for providing a fluid tight seal between said nose and said internal wall surfaces of said pipe when said anchor element of said coupling apparatus is disposed within said pipe, the means for providing a fluid tight seal including, a rigid backup ring arranged around said nose and engaged with said upstanding end portions for bridging gaps left therebetween, a deformable backup ring arranged around said nose and said rigid ring for filling circumferential spaces between said rigid ring and said internal wall surfaces, and an annular sealing member arranged around said nose and said deformable ring for sealingly engaging said nose with said internal wall surface of said pipe when said upstanding end portion of said anchor element is disposed within said pipe and is expanded radially outwardly to engage said internal wall surface of said pipe.

25. The coupling apparatus of claim 24, wherein said mandrel includes an enlarged portion, said anchor element including a base slidably disposed on said enlarged portion of said mandrel, the base sliding radially outwardly on said enlarged portion of said mandrel when said upstanding end portion of said anchor element is expanded radially outwardly.

26. Perforating apparatus, comprising:

a pipe having internal wall surfaces and adapted to contain one or more shape charges; and an end closure member means adapted to be disposed in each end of said pipe, each said closure member means functioning to expand radially outwardly against said internal wall surfaces of said pipe when disposed within an end of said pipe, each of said end closure member means including, a mandrel including a center portion, an anchor element movable arranged around said mandrel and adapted to be disposed within said pipe, said anchor element including an upstanding end portion having irregularly shaped outer edges, an inner edge of said upstanding end portion defining a recess around said mandrel, and means disposed between the center portion of said mandrel and said upstanding end portion of said anchor element for expanding said upstanding end portion radially outwardly, the irregularly shaped outer edges of said upstanding end portion gripping said internal wall surfaces of said pipe when said anchor element is disposed within said pipe and said upstanding end portion of said anchor element is expanded radially outwardly, the means for expanding including, a first body slidably arranged on said mandrel and having a nose complementally fitted in said recess, and a second body threadedly coupled to said center portion for advancing said nose into said recess and shifting said anchor element outwardly to further grip said irregularly shaped outer edges of said upstanding end portion against said internal wall surfaces of said pipe when said anchor element is disposed within said pipe; and means for providing a fluid tight seal between said nose and said internal wall surfaces of said pipe when said anchor element of said closure member means is disposed within said pipe, the means for providing a fluid tight seal including, a rigid backup ring arranged around said nose and engaged with said upstanding end portions for bridging gaps left therebetween, a deformable backup ring arranged around said nose and said rigid ring for filling circumferential spaces between said rigid ring and said internal wall surfaces, and an annular sealing member arranged around said nose and said deformable ring for sealingly engaging said nose with said internal wall surface of said pipe when said upstanding end portion of said anchor element is disposed within said pipe and is expanded radially outwardly to engage said internal wall surface of said pipe.

27. The perforating apparatus of claim 26, wherein said mandrel includes an enlarged portion, said anchor element including a base slidably disposed on said enlarged portion of said mandrel, the base sliding radially outwardly on said enlarged portion of said mandrel when said upstanding end portion of said anchor element is expanded radially outwardly.

* * * * *